US007578572B2

(12) United States Patent
Naruse

(10) Patent No.: US 7,578,572 B2
(45) Date of Patent: Aug. 25, 2009

(54) IMAGE FORMING APPARATUS USING INKJET PROCESS CAPABLE OF MAINTAINING AN IMAGE FORMING QUALITY

(75) Inventor: Shinichiro Naruse, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 399 days.

(21) Appl. No.: 11/441,857

(22) Filed: May 26, 2006

(65) Prior Publication Data

US 2006/0268053 A1 Nov. 30, 2006

(30) Foreign Application Priority Data

May 27, 2005 (JP) ..... 2005-154793

(51) Int. Cl.
*B41J 2/165* (2006.01)

(52) U.S. Cl. ..... 347/29; 347/30; 347/32

(58) Field of Classification Search ..... 347/23, 347/24, 29, 30, 32, 33, 35
See application file for complete search history.

(56) References Cited

U.S. PATENT DOCUMENTS 6,561,620 B2 * 5/2003 Pietrzyk et al. ..... 347/34
7,121,652 B2 * 10/2006 Harada et al. ..... 347/85
2005/0146554 A1 7/2005 Asanuma et al.
2005/0194730 A1 9/2005 Nishida et al.

FOREIGN PATENT DOCUMENTS

| | | | |
|---|---|---|---|
| JP | 06-091887 | | 4/1994 |
| JP | 411001001 A | * | 1/1999 |
| JP | 2000-153616 | | 6/2000 |
| JP | 2002-225293 | | 8/2002 |
| JP | 2002-283581 | | 10/2002 |
| JP | 2004-202803 | | 7/2004 |

* cited by examiner

*Primary Examiner*—Shih-wen Hsieh
(74) *Attorney, Agent, or Firm*—Cooper & Dunham, LLP

(57) ABSTRACT

This patent specification describes an image forming apparatus which includes a carriage, a recording head mounted on the carriage, having a nozzle, and configured to form an image by ejecting recording liquid from the nozzle, a self-maintenance mechanism configured to maintain the recording head in a predetermined condition, which includes a cap member configured to cap the recording head and an absorption mechanism configured to absorb the unused recording liquid ejected into the cap member from the recording head, and a shielding member configured to prevent a flying liquid droplet generated when the absorption mechanism absorbs the unused recording liquid from attaching to a predetermined member of the image forming apparatus.

13 Claims, 10 Drawing Sheets

IMAGE FORMING APPARATUS USING INKJET PROCESS CAPABLE OF MAINTAINING AN IMAGE FORMING QUALITY

BACKGROUND

1. Field

This patent specification describes an image forming apparatus using inkjet capable of maintaining an image forming quality.

2. Discussion of the Background

Most of image forming apparatuses for use in a printer, a facsimile, a copier, and a multifunction apparatus which prints, faxes, copies, and so on generally employ an electrophotographic process or an inkjet process for image forming. A background image forming apparatus using the inkjet process (which is hereinafter referred to as a background inkjet printer) is popularly used where a cost is a critical factor.

One of key mechanisms for the background inkjet printer is a self-maintenance mechanism for maintaining a recording head in a clean condition. The recording head is mounted on a carriage to move in an orthogonal direction to a paper feed and is configured to eject recording liquid to form an image. The maintenance mechanism includes an absorption cap and a wiper blade. The absorption cap receives ink ejected from a nozzle of the recording head and the ink is absorbed. The wiper blade wipes the nozzle surface of the recording head.

The wiper blade may be arranged on a belt which moves in an orthogonal direction to a scanning direction of the carriage. Liquid droplets of the recording liquid adhered on the nozzle surface of the recording head are wiped and eliminated by the blade formed on the surface of the moving belt.

Ejection of the recording liquid to the absorption cap and absorption from the absorption cap tends to generate liquid mists. The liquid mists may fly and adhere to various members of the background inkjet printer. To attempt to solve this liquid mists problem, liquid mist absorbents have been placed at neighboring region of the nozzle of the recording head so as to absorb the liquid mists. However, the liquid mist absorbents are not sufficient to completely absorb the liquid mists.

SUMMARY

This patent specification describes a novel image forming apparatus which includes a carriage, a recording head mounted on the carriage, having a nozzle, and configured to form an image by ejecting recording liquid from the nozzle, a self-maintenance mechanism configured to maintain the recording head in a predetermined condition, which includes a cap member configured to cap the recording head and an absorption mechanism configured to absorb the unused recording liquid ejected into the cap member from the recording head, and a shielding member configured to prevent a flying liquid droplet generated when the absorption mechanism absorbs the unused recording liquid from attaching to a predetermined member of the image forming apparatus.

This patent specification further describes a novel image forming apparatus which includes the shielding member whose size is greater than an opening area of the cap member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
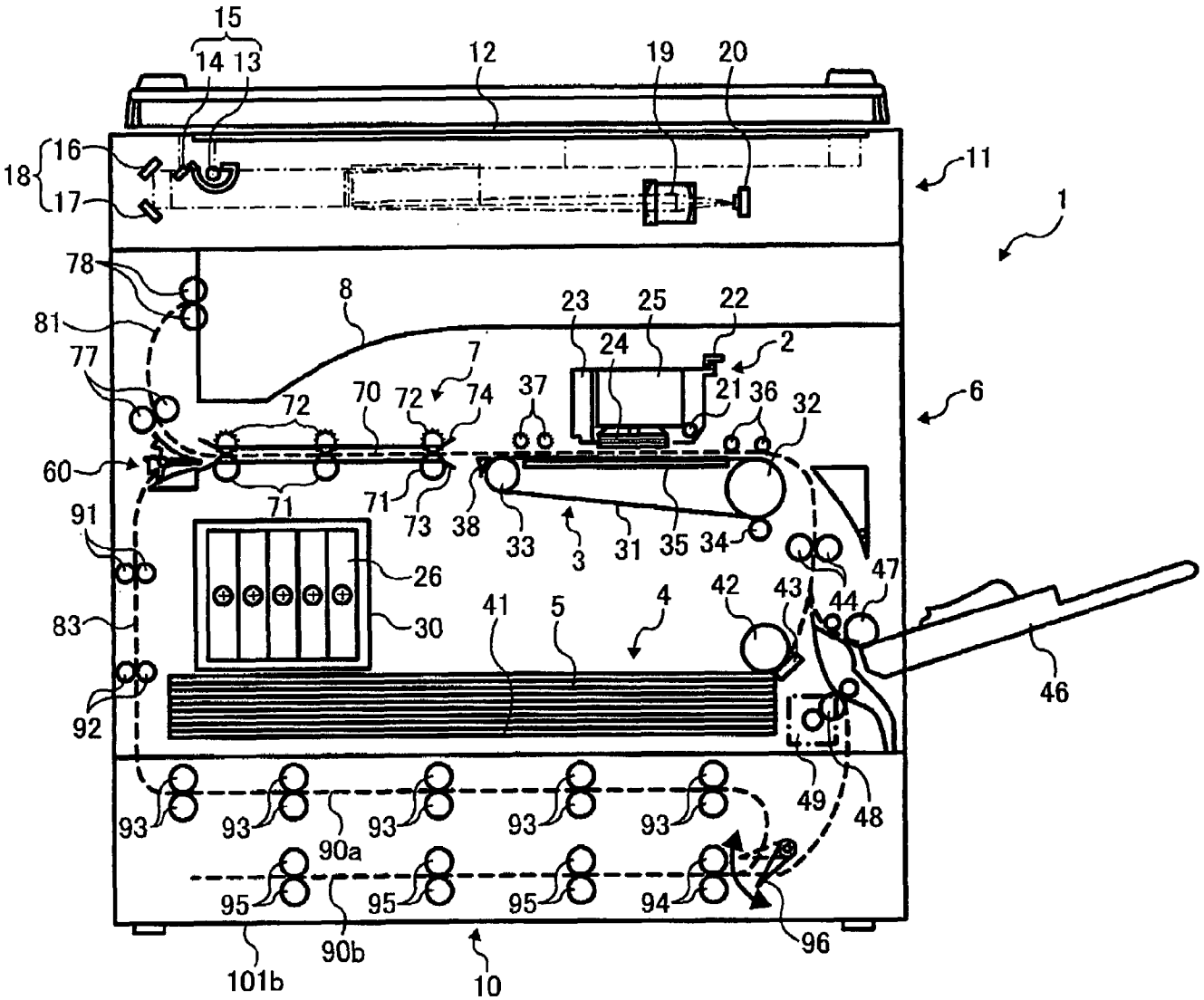
FIG. 1 illustrates an image forming apparatus according to an exemplary embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 5, a carriage is described.

Figure 2:
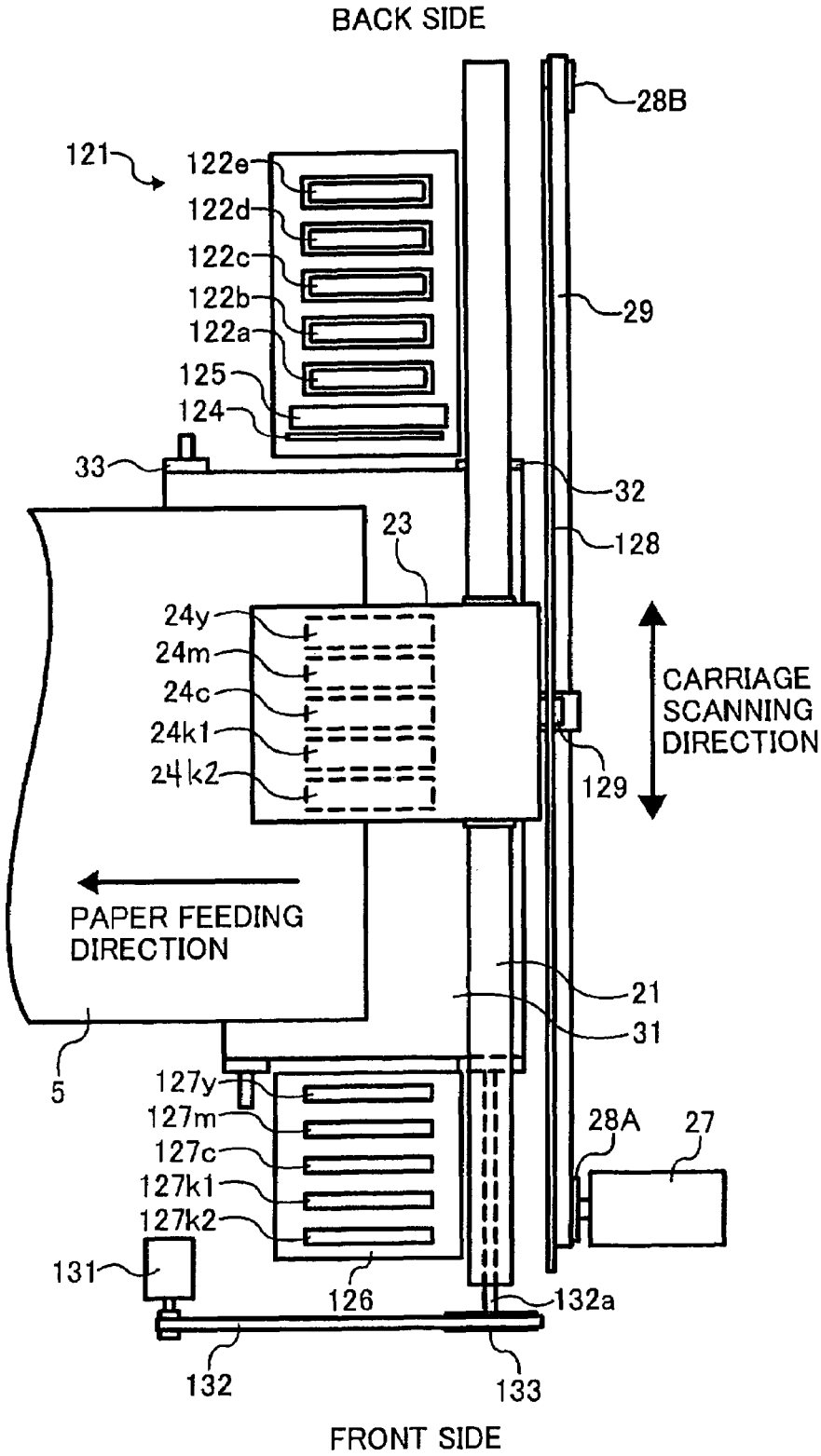
FIG. 2 illustrates a top view of a portion of the image forming apparatus of FIG. 1.

FIG. 1 illustrates an image forming apparatus 1 according to an exemplary embodiment, and FIG. 2 illustrates a top view of a portion of the image forming apparatus 1 of FIG. 1. The image forming apparatus 1 includes a image forming unit 2, a vertical scan unit 3, a paper supply unit 4, a paper output unit 7, a paper output tray 8 and a double-side printing unit 10 in a main body 6.

The image forming unit 2 forms an image on a paper 5 being conveyed in a printing zone. The vertical scan unit 3 conveys the paper 5 fed from the paper supply unit 4. The paper supply unit 4 is arranged at a bottom of the main body 6 and feeds papers one after another.

The paper 5 is conveyed by the vertical scan unit 3 to a position to face the image forming unit 2. An image is formed by the image forming unit 2 by ejecting liquid droplet while conveying. The paper 5 is output onto the paper output tray 8.

When double-side printing is performed, the paper 5 is fed to the double-side printing unit 10 arranged in the main body 6. The paper 5 is fed back again to the vertical scan unit 3 by a switchback convey mechanism. An image is formed at both sides of the paper 5 and the paper 5 is output onto the paper output tray 8.

The image forming apparatus 1 also includes an image reading unit 11 (scanner) as an image input mechanism to read the image (printing data) arranged above the paper output tray 8 of the main body 6. The image reading unit 11 includes a first scanning optical system 15 and a second scanning optical system 18. The first scanning optical system 15 includes an illumination source 13 and a mirror 14. The second scanning optical system 18 includes mirrors 16 and 17.

At the image reading unit 11, image on a document placed on a contact glass 12 is read by moving the first and second scanning optical systems 15 and 18. A scanned document image is going through a lens 19 and is read by an image reading device 20 placed behind the lens 19 to generate an image signal. After the image signal is digitized, an image forming process is performed with the read image signal to print the processed data.

Further, the image forming apparatus 1 is configured to receive printing image data sent from external image input mechanisms through a cable or a network. The printing image data is processed at the image forming unit 2. The external image input mechanisms are image processing apparatuses (such as a personal computer), external image reading apparatuses (such as an image scanner) and imaging devices (such as a digital camera).

The image forming unit 2 includes a carriage 23. The carriage 23 is held by a guide rod 21 and a guide stay 22 as shown in FIGS. 1 and 2. The carriage 23 is capable of moving in a scanning direction via a timing belt 29 extended along a driving pulley 28A driven by a main scanning motor 27 and a sub-pulley 28B.

Recording heads 24 are mounted on the carriage 23. Each recording head 24 includes a liquid-droplet-ejection head which ejects a color liquid droplet. While the carriage 23 is being moved in a main scanning direction and the paper is conveyed in a vertical scanning direction by the vertical scan unit 3, an image is formed by ejecting liquid droplet from the recording heads 24. As shown in FIGS. 1-2, the carriage 23 has a shuttle type configuration.

The recording head 24 includes five liquid-droplet-ejection heads which are two black liquid-droplet-ejection heads 24*k*1, 24*k*2 to eject black (Bk) ink, a cyan liquid-droplet-ejection head 24*c*, a magenta liquid-droplet-ejection head 24*m* and a yellow liquid-droplet-ejection head 24*y*. Each color ink is supplied from each sub-tank 25 mounted on the carriage 23.

Meanwhile, ink cartridges 26 are removably arranged at a cartridge 30 in the main body 6 so as to be replaced from the front side of the main body 6. The ink cartridges 26 comprise a black (Bk) ink, a cyan (C) ink, a magenta (M) ink and yellow (Y) ink. Each color ink is supplied from a corresponding color ink cartridge to a corresponding color sub-tank. As for the black ink, it is possible that one black color ink cartridge 26 supplies the black ink to the two black color sub-tanks 25.

As for the recording heads 24, a variety of types of recording head are applicable, such as piezo-type, thermal-type and electrostatic-type recording heads. The piezo-type recording head employs a piezoelectric element as a pressure generation mechanism (actuator) to give pressure to ink in an ink flow path. The ink is ejected by changing shape of vibrating plates which form walls of the ink flow path because of change of volume of the ink flow path.

The thermal-type recording head employs a heating resistance. The ink is ejected due to air bubbles generated by heating the ink in the ink flow path. The electrostatic-type recording head includes an electrode and a vibrating plate facing each other. The ink is ejected by changing shape of the vibrating plate with an electrostatic force between the vibrating plate and the electrode.

A self-maintenance mechanism 121 is arranged in one of the non-printing areas in a scanning direction of the carriage 23 as shown in FIG. 2 to maintain and recover a performance of nozzles of the recording heads 24 in a clean condition. The self-maintenance mechanism 121 includes a moisturizing-absorbing cap 122*a*, four moisturizing caps 122*b* to 122*e*, a wiper blade 124 and an extra-ink receiving member 125.

The moisturizing-absorbing cap 122*a* is configured to maintain moisture and to absorb ink. The wiper blade 124 wipes the nozzle surface of the recording head 24. The extra-ink-receiving member 125 is configured to receive extra-ink which does not contribute to form the image.

Furthermore, extra-ink-receiving members 126 are arranged in another one of non-printing areas in the scanning direction of the carriage 23 as shown in FIG. 2 to receive extra-ink which does not contribute to form the image. The extra-ink receiving members 126 includes five openings 127*k*1, 127*k*2, 127*c*, 127*m* and 127*y*, respectively for black, cyan, magenta and yellow colors.

A linear encoder is arranged to detect a position of the carriage 23 in the main scanning direction. The linear encoder has an encoder scale 128 and an encoder sensor 129. The encoder scale 128 having a slit is arranged along the scanning direction of the carriage 23 upstream of a paper feed. The encoder sensor 129 is arranged at a front side of the carriage 23 and is configured to detect the slit of the encoder scale 128.

The vertical scan unit 3 includes a convey belt 31, a convey roller 32, a sub-roller 33, a charging roller 34, a guide roller 35, two pushing rollers 36, two spur rollers 37 and a releasing pawl 38 as shown in FIG. 1. The convey belt 31 is an endless belt and extends around the convey roller 32 and the sub-roller 33. The convey roller 32 is driven by a motor and the sub-roller 33 is configured to apply tension to the convey belt 31.

The charging roller 34 is configured to charge the surface of the convey belt 31 by applying an alternating high voltage from an AC bias voltage supply unit (high voltage power supply). The guide roller 35 is configured to guide the convey belt 31 within a region facing the image forming unit 2. The pushing rollers 36 are configured to push the paper 5 to the convey belt 31 at a position facing the convey roller 32. The spur rollers 37 are configured to press an upper side of the paper 5 where the image is formed by the image forming unit 2. The releasing pawl 38 is configured to release the paper 5 from the convey belt 31.

The convey roller 32 is rotated due to rotation of timing roller 133 which is driven to rotate by a secondary motor 131 via a timing belt 132. Then, the convey belt 31 of the vertical scan unit 3 is rotated in a paper conveying direction (vertical scanning direction).

The convey belt 31 has a two-layer configuration of front and back film layers. The front film layer is configured to absorb the paper 5 and is made of a pure resin material with non-resistance control such as a pure ETFE (Ethylene Tetra Fluoro Ethylene) material. The back film layer is made of same material as the front film layer but includes carbon to control a resistance. The back film has a medium-range resistance to be used as a ground layer. However, any film layers configuration such as one film layer and triple film layers configuration can be applicable.

The paper supply unit 4 includes a paper cassette 41, a paper feed roller 42, a friction pad 43 and a resist roller 44. The paper cassette 41 is configured to be released from the front of the main body 6 and stores a plurality of papers 5. The papers 5 are separated by the paper feed roller 42 and the friction pad 43. Then, a paper 5 is sent one after another. The resist roller 44 performs a resist processing to the paper 5.

The paper supply unit 4 further includes a manual paper feed tray 46, a manual feed roller 47 and a convey roller 48. The manual paper feed tray 46 is configured to store a plurality of papers 5. The manual feed roller 47 feeds the paper 5 one after another from the manual paper feed tray 46. The convey roller 48 is configured to convey the paper 5 fed from an optional paper cassette and the double-side printing unit 10 arranged at a lower part of the main body 6.

The convey members such as the paper feed roller 42, the resist roller 44, the manual feed roller 47 and the convey roller 48 are driven to rotate by a paper feed motor 49 via an electromagnetic clutch(not shown). The paper feed motor 49 is comprised of a HB-type (hybrid-type) stepping motor.

The paper output unit 7 includes three pair of convey rollers 71 and spur rollers 72 and a pair of flip rollers 77 and paper-output rollers 78. The three pair of convey rollers 71 and spur rollers 72 convey the paper 5 which is output from the releasing pawl 38 of the vertical scan unit 3. The pair of flip rollers 77 and paper-output rollers 78 are configured to receive the paper 5 output from the last pair of the convey rollers 71 and spur rollers 72 and send the paper 5 to the paper output tray 8 via a flip-output-paper path 81 (first output path) so as to output the paper 5 facedown.

A paper convey path 70 is arranged between a lower guide 73 and an upper guide 74 and is configured to guide the paper 5 to be conveyed. A branch mechanism 60 is arranged at an output side of the convey path 70 so as to switch the path to send the paper 5 to the first paper path 81, or to a second paper path (not shown), or to the double-side printing unit 10. The second paper path is configured to send the paper 5 to an extra straight paper-output tray which is installed optionally.

Further, a vertical double-side-paper-convey path 83 is arranged at a side of the main body 6 to feed the paper 5 downward to the double-side printing unit 10. A pair of entrance rollers and exit rollers are arranged at the vertical double-side-paper-convey path 83 so as to convey the paper 5 downward.

The double-side printing unit 10 includes a horizontal importing-convey path 90*a* and a switchback path 90*b*. The horizontal importing-convey path 90*a* includes five pair of double-side-paper-convey rollers 93. The switchback path 90*b* includes a pair of double-side exit rollers 94 and three pair of double-side-paper-convey rollers 95.

Moreover, the double-side printing unit 10 includes a branch plate 96. The branch plate 96 is swingablly arranged and is configured to switch between a first path and a second path. In the first path, the paper 5 is conveyed from the horizontal importing-convey path 90*a* to the switchback path 90*b*. In the second path, the paper 5 is conveyed from the switchback path 90*b* to the convey roller 48. The paper 5 is then conveyed to the resist rollers 44 again via the convey roller 48.

Figure 3:
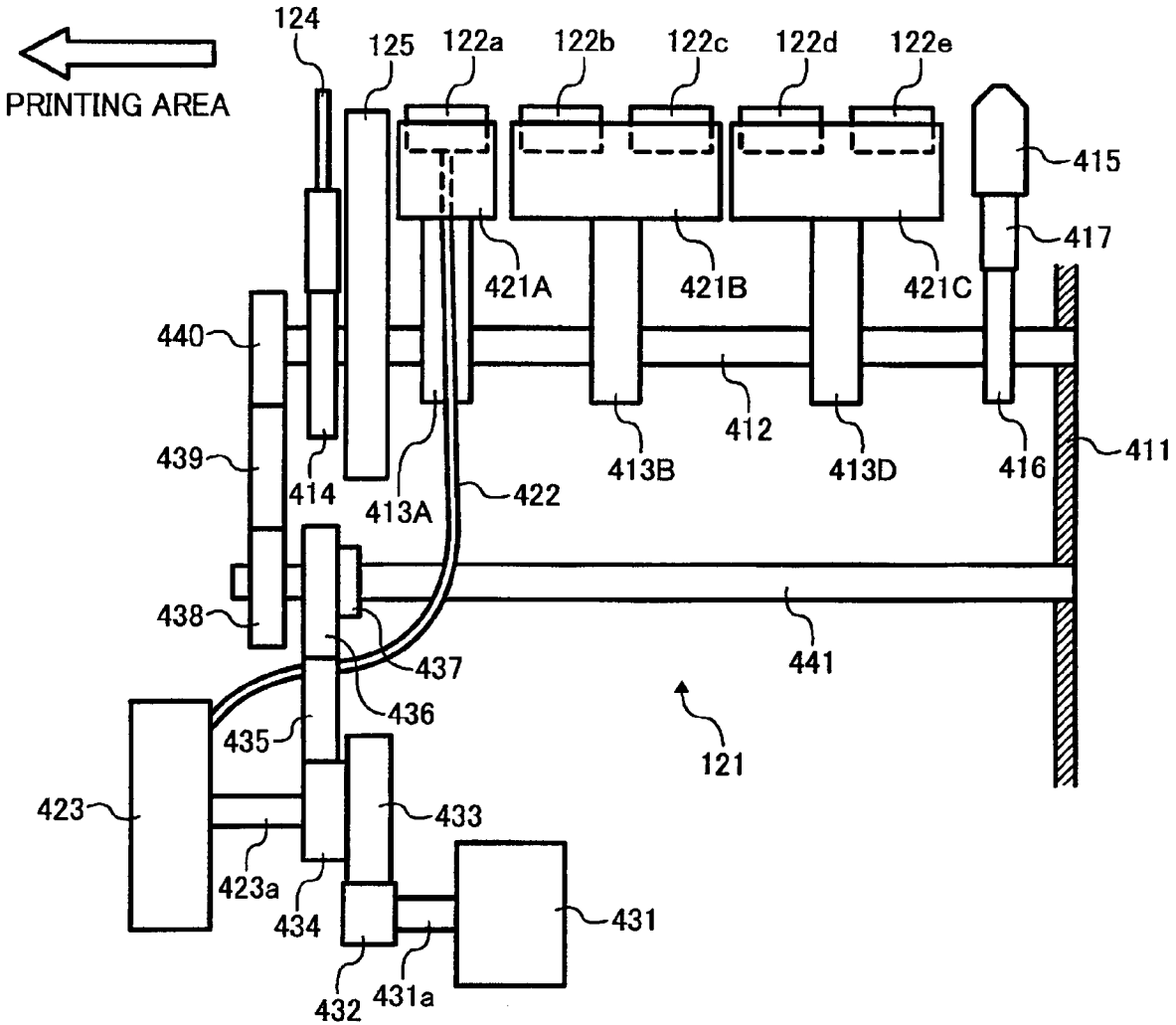
FIG. 3 illustrates schematically a portion of a self-maintenance mechanism of the image forming apparatus of FIG. 1.

The self-maintenance mechanism 121 will now be described with reference to FIG. 3. The self-maintenance mechanism 121 further includes three cap holders 421. More specifically, a cap holder 421A includes a holding mechanism to hold the moisturizing-absorbing cap 122*a*. The other cap holders 421B and 421C include holding mechanisms to hold the moisturizing caps 122*b* and 122*c*, respectively.

As previously described, the self-maintenance mechanism 121 includes the wiper blade 124 and the extra-ink receiving member 125. The wiper blade 124 is a cleanup mechanism to cleanup (wipe) the nozzle surface of the recording head 24. The extra-ink-receiving member 125 is configured to receive extra-ink which does not contribute to form the image.

A tubing pump (absorption pump) 423 is an absorption mechanism and is connected to the moisturizing-absorbing cap 122*a* via a flexible tube 422. If one of the recording heads 24 is to be maintained and recovered, the recording head 24 is selectively moved to a position to be capped by the moisturizing-absorbing cap 122*a*.

A camshaft 412 is arranged at the lower part of the cap holders 421A to 421*c* and is rotatably held by a frame 411. Cap cams 413A to 413C and a wiper cam 414 are arranged on the camshaft 412. The cap cams 413 make the cap holders 421 move up and down. The wiper cam 414 makes the wiper blade 124 move up and down. Each top position of the cap holder 122 which is possible to reach may be different from each other. In FIG. 3, however, the cap holders 421 and the top position of the caps 122 and the cams 413 are shown to have an equal top position for simplicity.

A carriage rock 415 is arranged to engage with the carriage 23 so as to rock the carriage 23. The carriage rock 415 is pulled to be fixed in an upper direction by a pressuring spring (not shown), and is made to go up and down with a carriage rock arm 417 driven by a carriage rock cam 416 which is arranged at the camshaft 412.

A motor gear 432 arranged at a motor shaft 431*a* is engaged with a pump gear 433 arranged at a pump shaft 423*a*. An intermediate gear 434 which is integrated with the pump gear 433 is engaged with an intermediate gear 436 having an one-way clutch 437 via an intermediate gear 435. An intermediate gear 438 which commonly owns the shaft of the intermediate gear 436 is engaged with a cam gear 440 fixed to the camshaft 412 via an intermediate gear 439. With the configuration, the tubing pump 423 and the camshaft 412 are rotated by transferring a rotational force of a motor 431.

In the self-maintenance mechanism 121, the tubing pump 423 rotates to absorb ink in the moisturizing-absorbing cap 122*a* by the rotation of the motor gear 432, the pump gear 433, the intermediate gears 434-436 in accordance with a normal rotation of the motor 431. Other gears following the intermediate gear 438 do not rotate because the gears are released by the one-way clutch 437.

When the motor 431 is rotated backward, the gears following the intermediate gear 438 are to be engaged by the one-way clutch 437. The rotation force of the motor 431 is transferred to a cam gear 440 via the pump gear 433, and intermediate gears 434, 435, 436, 438 and 439. The camshaft 412 is then rotated. The tubing pump 423 is configured not to rotate with the reversal rotation of the pump shaft 423*a*.

Further, the recording head 24 of the carriage 23 is selectively moved to a position facing each moisturizing-absorbing cap 122. Each nozzle surface of the recording head 24 is capped with the moisturizing-absorbing cap 122*a* to 122*e* by rotating the camshaft 412. When the recovery operation is performed, the recording head 24 of the carriage 23 is selectively moved to a position facing the moisturizing-absorbing cap 122*a*. The nozzle surface of the recording head 24 is capped with the moisturizing-absorbing cap 122*a* by rotating the camshaft 412.

Ink in the nozzle of the recording head 24 is absorbed by the rotation of the tubing pump 423. After the carriage 23 is moved to the printing area, residual ink in the moisturizing-absorbing cap 122*a* is absorbed.

Figure 4:
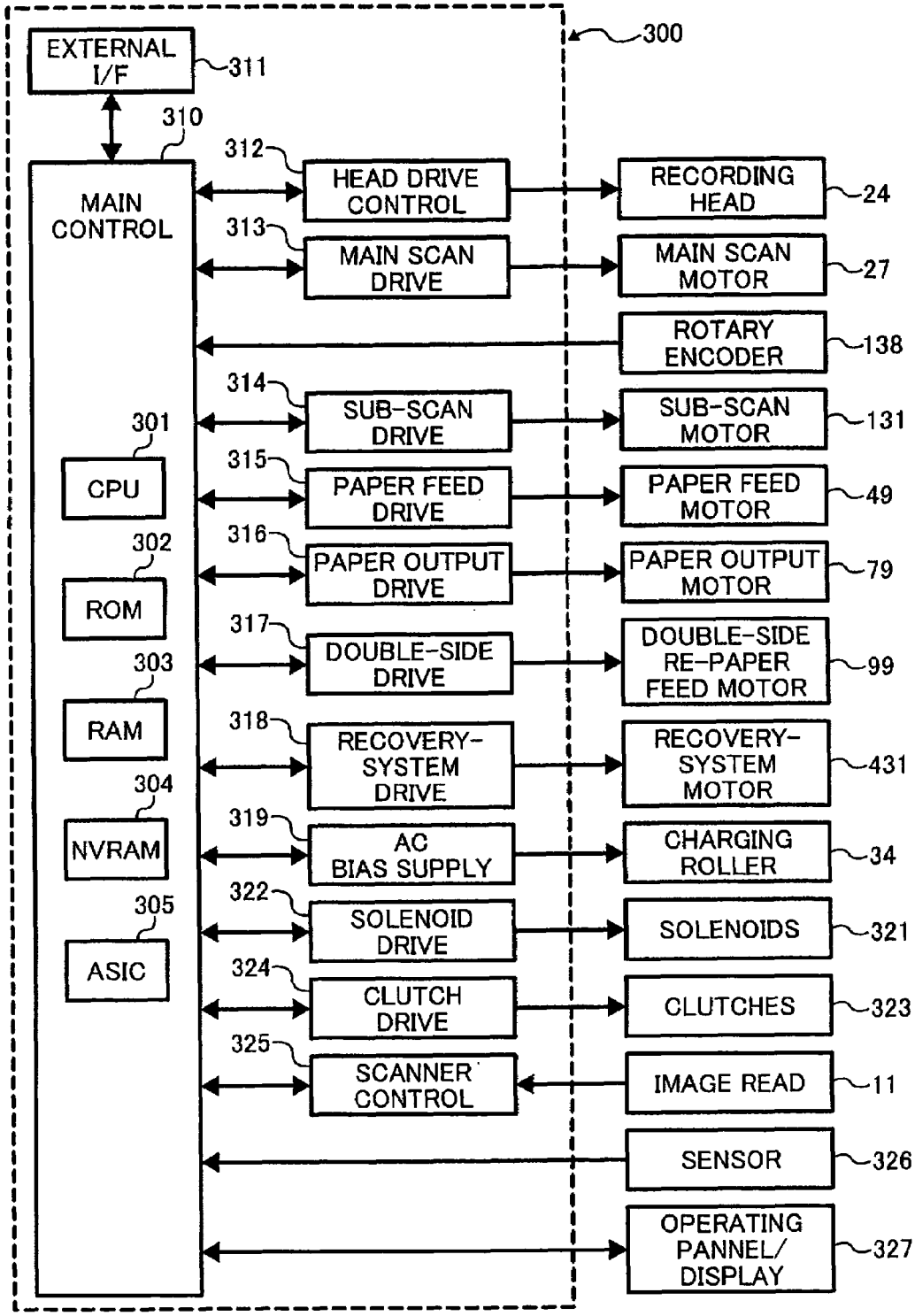
FIG. 4 illustrates a block diagram of a control unit of the image forming apparatus.

FIG. 4 illustrates blocks of a control unit 300 of the image forming apparatus 1. The control unit 300 includes a main control unit 310 to control a whole image forming apparatus 1. The main control unit 310 includes a CPU (central processing unit) 301, a ROM (read only memory) 302, a RAM (random access memory) 303, a NVRAM (non volatile random access memory) 304, a ASIC (application specific integrated circuit) 305.

The CPU 301 executes program software. The ROM 302 stores the program software and other fixed data. The RAM 303 temporally stores image data and so on. The NVRAM 304 stores data even when a power for the image forming apparatus 1 is not supplied. The ASIC 305 performs a variety of signal processing for the image data such as image processing, sorting the data and controlling input and output signals for the image forming apparatus 1.

The control unit 300 further includes an external I/F (interface) 311, a head driving control 312, a main scan drive 313, a sub-scan drive 314, a paper feed drive 315, a paper output drive 316, a double-sides drive 317, a recovery-system drive 318 and an AC bias drive 319. The external I/F 311 is arranged between the host image forming apparatus and the main control unit 310 and is configured to send and receive data and signals. The head driving control 312 includes head driver software and is configured to control the drive of the recording head 24.

The main scan drive 313 is configured to drive the main motor 27 by which the carriage 23 is driven and scanned. The sub-scan drive 314 is configured to drive the sub-scan motor 131 in accordance with a detection result of a rotary encoder 138. The paper feed drive 315 is configured to drive a paper feed motor 49. The paper output drive 316 is configured to drive a paper output motor 79 by which the rollers at paper output unit 7 are rotated.

The double-sides drive 317 is configured to drive double-sides paper re-feed motor 99 by which the rollers at double-sides paper unit 7 are rotated. The recovery system drive 318 is configured to drive the maintenance-recovery motor 431 by which the maintenance-recovery system 121 is driven. The AC bias drive 319 is configured to supply an AC voltage to the charging roller 34.

Furthermore, the control unit 300 includes a solenoid (SOL) drive 322, a clutch drive 324 and a scanner control 325. The SOL drive 322 is configured to drive a variety of solenoid products 321. The clutch drive 324 is configured to drive electrostatic clutches for paper feed. The scanner control 325 is configured to control the image reading unit 11.

The main control unit 310 receives a plurality of input detection signals from sensors 326 which detect the papers 5. Further, the main control unit 310 receives a plurality of input key signals from key-signal generators such as a numerical keyboard and a print-start key and signals from an operating panel and display 327. After execution, display information is output.

An image forming operation in the image forming apparatus 1 will shortly be described. When alternative high voltages with a rectangular waveform having positive and negative potential values are applied to the charging roller 34 by the AC bias drive 319, the surface of the convey belt 31 is charged in accordance with the alternative high voltages because the charging roller 34 is attaching to the front layer of the convey belt 31.

Namely, a predetermined area of the surface of the convey belt 31 is positively charged by the high positive voltage and a next predetermined area of the surface of the convey belt 31 is negatively charged by the high negative voltage. Thus, the convey belt 31 is charged up alternatively and non-uniformly with the predetermined area in a conveying direction.

The paper 5 is fed from the paper supply unit 4, or the manual paper feed tray 46, or the double-side printing unit 10. When the paper 5 is sent onto the convey belt 31, the paper 5 is immediately polarized along the electrical field and is attached onto the convey belt 31 by the electrostatic force. Then, the paper 5 is conveyed with the movement of the convey belt 31.

While the paper 5 is being conveyed intermittently by the convey belt 31, an image is formed on the paper 5 by ejecting one or more droplets of ink from the recording head 24 in accordance with printing data. The front portion of the paper 5 is released from the convey belt 31 by-the releasing pawl 38 and sent to the paper output tray 8 or to the double-side printing unit 10. The paper 5 is output after the image is formed on another side of the paper 5.

During a waiting state of the printing, the carriage 23 is moved to the self-maintenance mechanism 121 and an output portion of the nozzle of the recording head 24 is capped with the moisturizing-absorbing cap 122. Therefore, the output portion of the nozzle of the recording head 24 is maintained with an predetermined wet condition so as to avoid droplet ejection failure due to dried ink. Further, the extra-ink which does not contribute to form the image is ejected to the extra-ink receiving member 125 during the printing operation so that viscosity of the ink is kept constant and ejection performance is maintained in a good condition.

When droplet ejection failure takes place, the output portion of the nozzle of the recording head 24 is capped with the moisturizing-absorbing cap 122. Causes of the failure such as bubbles are absorbed with the ink from the output portion of the nozzle of the recording head 24 by the absorption mechanism via the flexible tube 422.

The ink and particles which are attached onto the output portion of the nozzle of the recording head 24 are removed by the cleanup mechanism so as to recover the ejection performance. The ink absorbed is collected in a recycle ink tank arranged at a lower part of the main body 6. The recycle ink is then absorbed and held with absorption materials arranged in the recycle ink tank.

Figure 5:
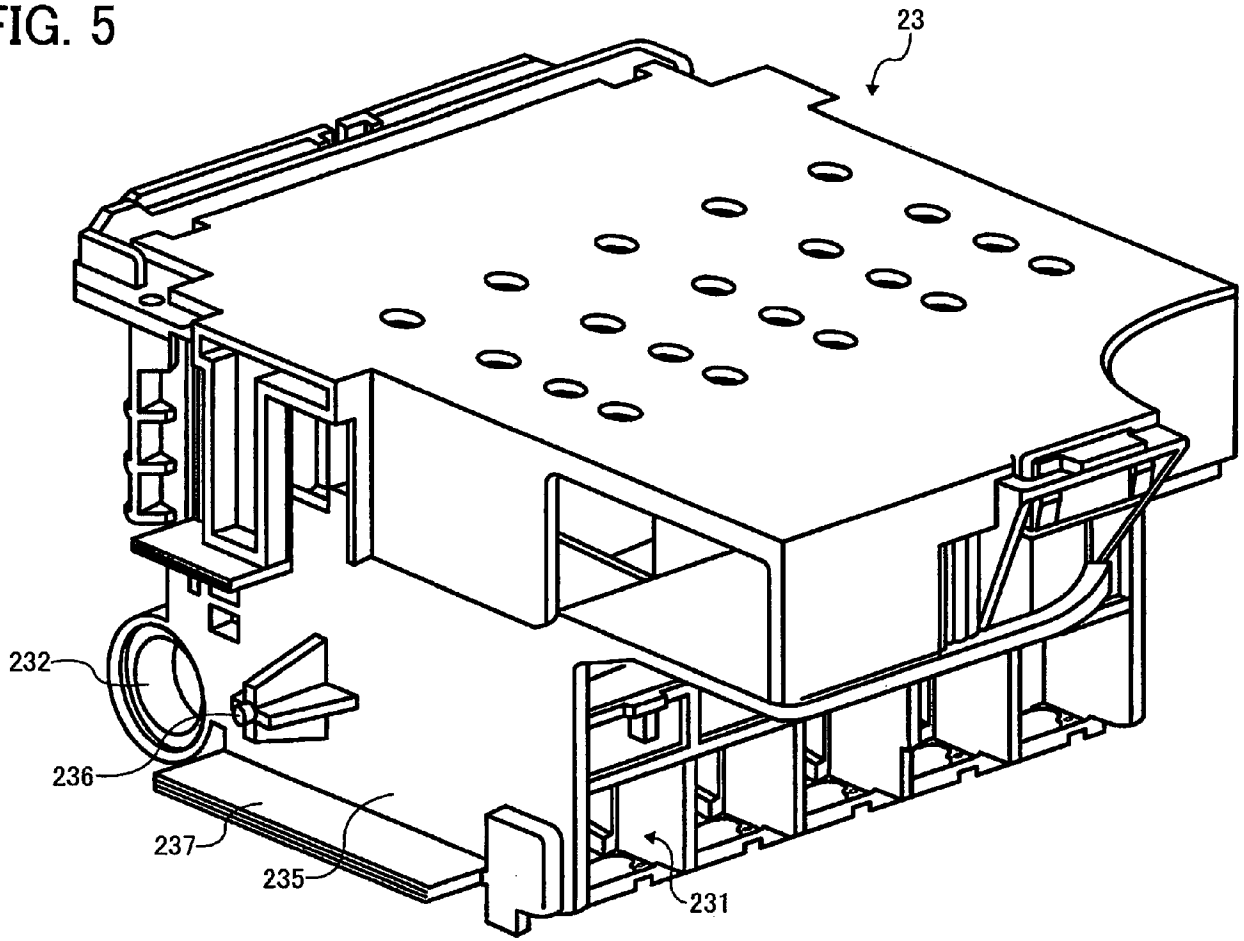
FIG. 5 illustrates a diagrammatic perspective view of a carriage of the image forming apparatus of FIG. 1.
Figure 6:
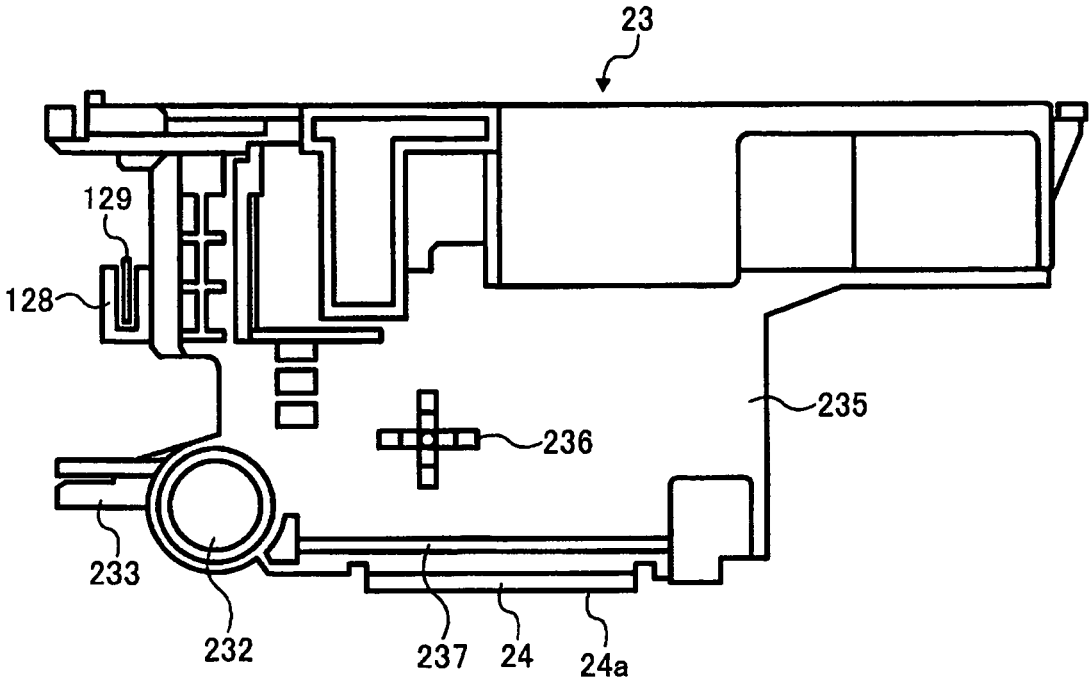
FIG. 6 illustrates a side view of the carriage of FIG. 5.
Figure 7:
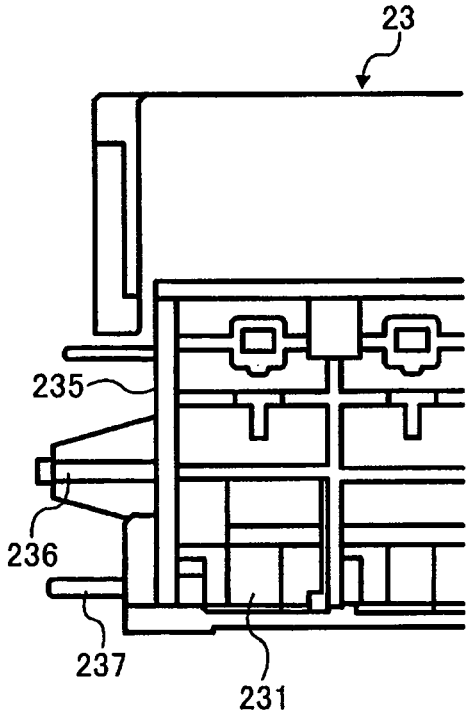
FIG. 7 illustrates a portion of the carriage of FIG. 6.

A shielding mechanism which prevents liquid droplet generated during the absorption process from attaching to predetermined members will be described referring to FIGS. 5 to 7. FIG. 5 illustrates a diagrammatic perspective view of the carriage 23. FIG. 6 illustrates a side view of the carriage 23. FIG. 7 illustrates a portion of the side view of the carriage 23 of FIG. 6.

The carriage 23 includes a head holder 231, a rod hole 232, a fastener means 233, an attachment member 236 and a shielding member 237 having a plate shape. The head holder 231 is configured to attach the recording head 24. The rod hole 232 is configured to hold the guide rod 21. The fastener means 233 fastens the timing belt 29. The attachment member 236 is configured to be attached to a side plate (not shown) to determine a home position with regard to a surface of a sidewall 235 of the self-maintenance mechanism 121.

The shielding member 237 is arranged at a position to prevent flying ink droplet generated when the residual ink remaining in the moisturizing-absorbing cap 122*a* is absorbed from attaching to the linear encoder scale 128 and/or other members nearby. More specifically, the shielding member 237 is arranged at a position to cover both shortest and longest lines drawn between the moisturizing-absorbing cap 122*a* and the linear encoder scale 128.

The shielding member 237 is arranged in a direction substantially parallel to a direction of nozzle surface 24*a* of recording head 24 along a paper conveying direction on the sidewall 235. The shielding member 237 can be a separate component from the carriage 23 and can be integrated in one piece with the carriage 23 using a resin material. The size of the shielding member 237 is designed to be bigger than the area of the opening of the moisturizing-absorbing cap 122*a* to make sure that the flying ink droplet is shielded.

Figure 8:
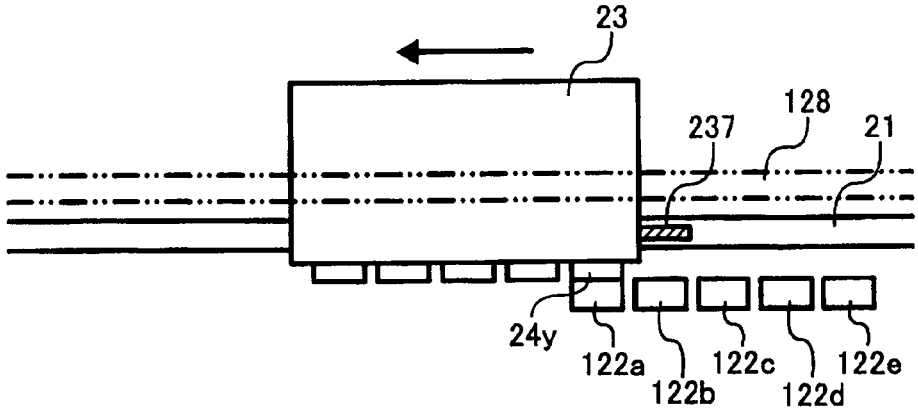
FIG. 8 illustrates schematically the carriage of FIG. 5 while being processed.

When the maintenance-recovery processing is performed, the recording head 24 is moved to a position to face the moisturizing-absorbing cap 122*a*. FIG. 8 illustrates the maintenance-recovery processing of the recording head 24 of the carriage 23. The carriage 23 is moving in a direction shown by an arrow in FIG. 8. The moisturizing-absorbing cap 122*a* is lifted up and the nozzle surface of the recording head 24*y* is capped. The tubing pump 423 starts to rotate and ink is absorbed from nozzle of the recording head 24*y* into the moisturizing-absorbing cap 122*a*.

Figure 9:
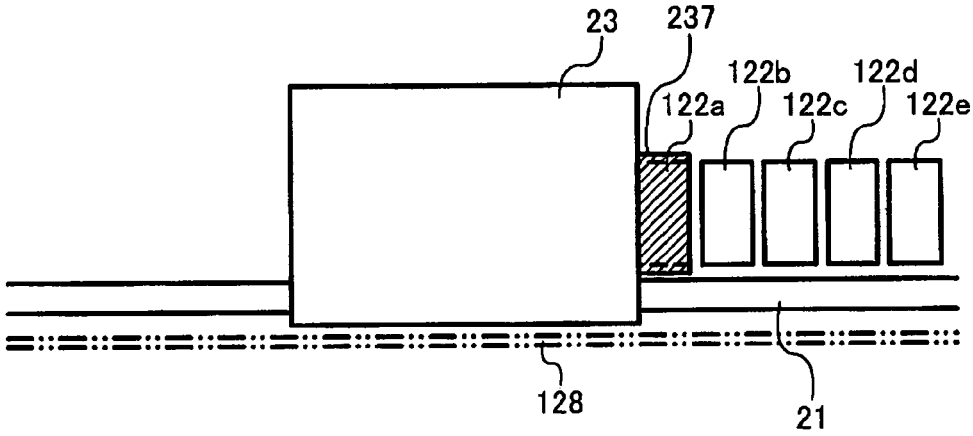
FIGS. 9 and 10 illustrate schematically the carriage of FIG. 5 placed at respective positions separated from the self-maintenance mechanism.
Figure 10:
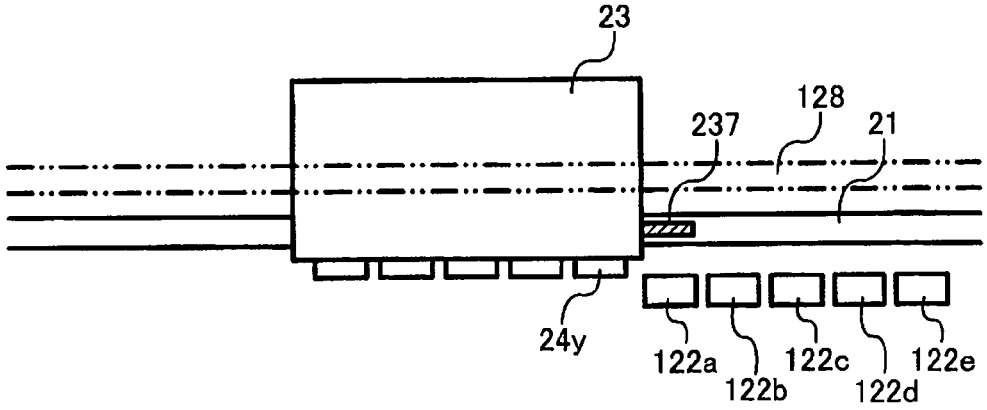

When the carriage 23 is move to the direction shown by an arrow in FIG. 8, the nozzle surface of the recording head 24*y* is wiped by the wiper blade 124. The carriage 23 is placed at a separated position from the self-maintenance mechanism 121 as shown in FIGS. 9 and 10. The shielding member 237 is stopped at a position above the moisturizing-absorbing cap 122*a*.

If bubbles are generated in the moisturizing-absorbing cap 122*a* which is separated from the recording head 24 when the residual ink is absorbed, bubbles may be broken and ink droplet may fly. However, the flying ink droplet is prevented by the shielding member 237 from attaching to the linear encoder scale 128. Therefore, it can be avoided that the linear encoder scale 128 becomes dirty because the flying ink droplet does not get to the linear encoder scale 128.

Thus, the image forming apparatus 1 includes the shielding member 237 which prevents the flying ink droplet generated at an absorption of residual of recording ink in the cap members from attaching a predetermined member. It can be avoided that the predetermined member becomes dirty due to the flying droplet of the ink, especially when the ink having high viscosity is used.

The shielding member is arranged in a direction substantially parallel to a direction of nozzle surface of recording head in this exemplary embodiment. The flying ink droplet can be shielded efficiently by locating at a closer position just above the opening of the cap member. In this exemplary embodiment, the shielding member is just needed to locate at a position on a line between the predetermined member to be protected and the cap member. Any modifications are possible.

Figure 11:
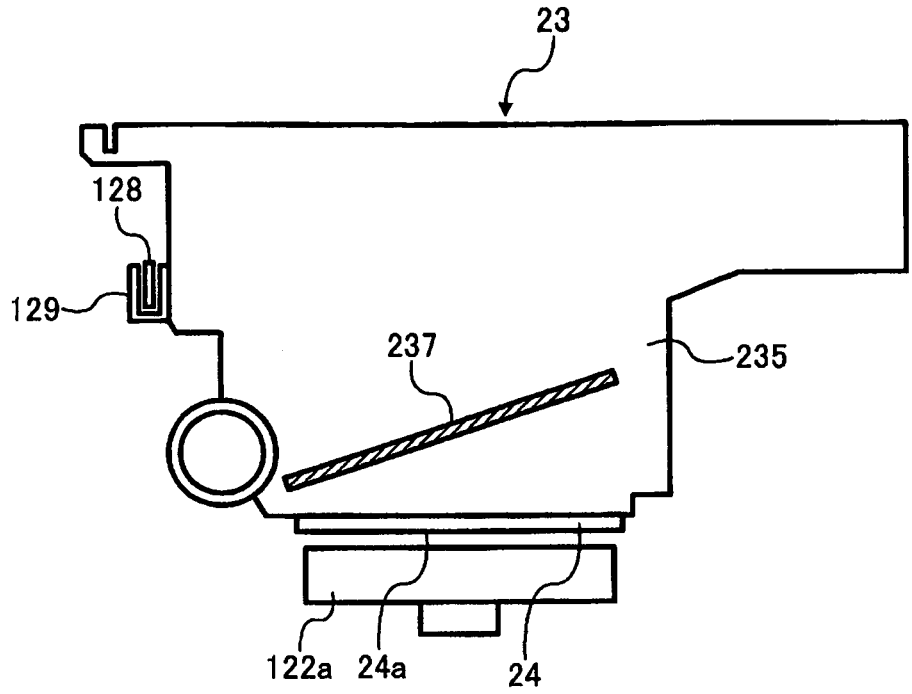
FIG. 11 illustrates a shielding member arranged on the sidewall and tilted with an angle to a nozzle surface of a recording head.
Figure 12:
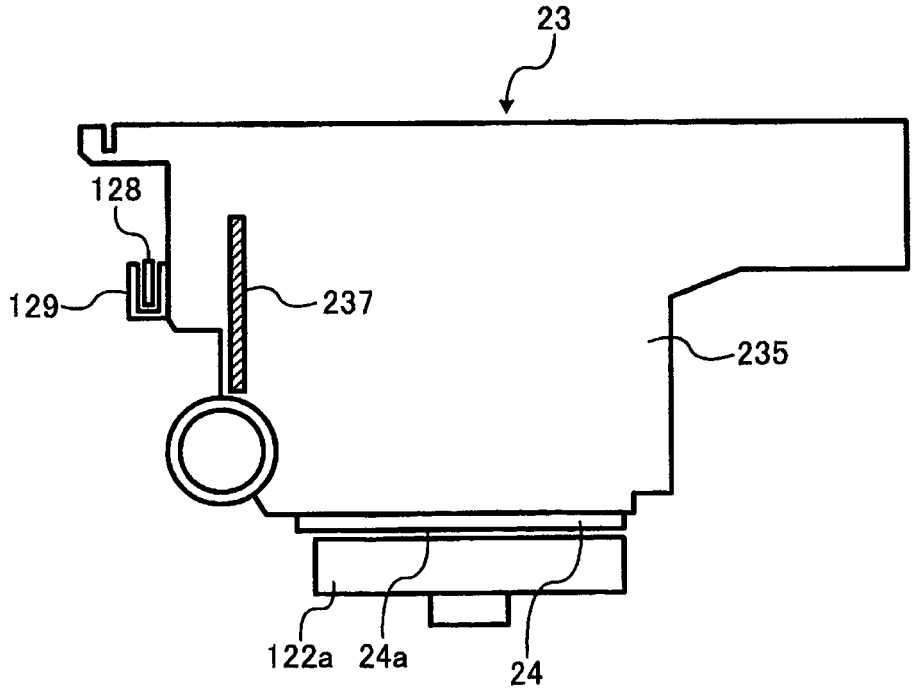
FIG. 12 illustrates the shielding member arranged in a direction substantially vertical to the nozzle surface of recording head on the sidewall.

The shielding member 237 can be arranged on the sidewall 235 to be tilted with an angle to a direction of nozzle surface 24*a* of the recording head 24 as shown in FIG. 11. The shielding member 237 can be arranged in a direction substantially vertical to a direction of nozzle surface 24*a* of recording head 24 on the sidewall 235 as shown in FIG. 12. In this case, the shielding member 237 may be placed at a closer position to the linear encoder scale 128 to be protected.

Figure 13:
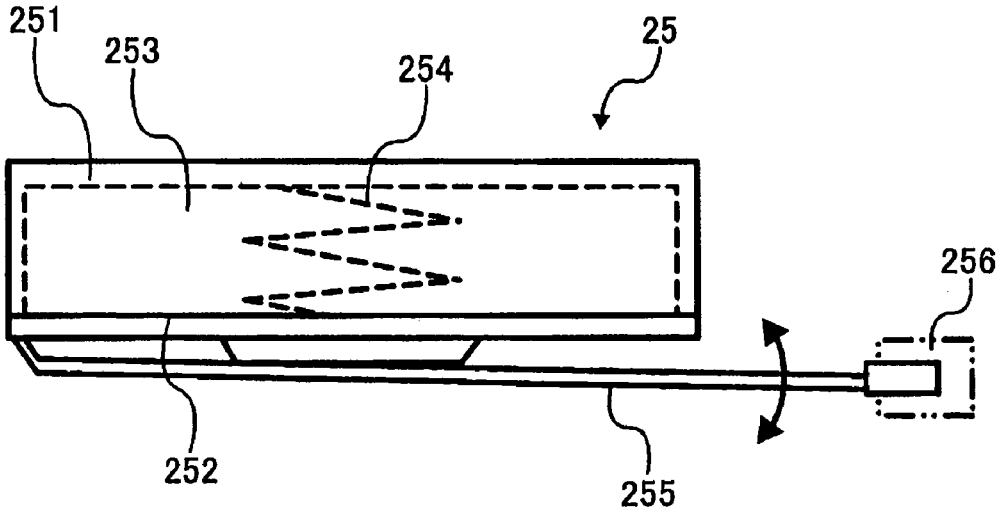
FIG. 13 illustrates a top view of the sub-tank according to another exemplary embodiment.
Figure 14:
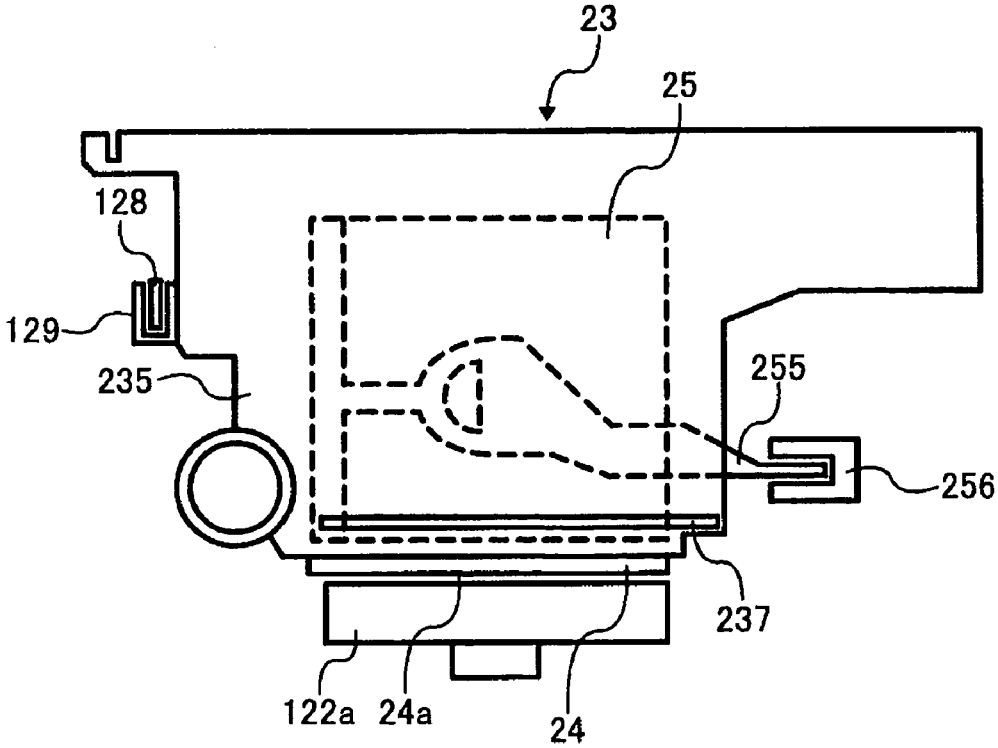
FIG. 14 illustrates a side view of a portion of the sub-tank of FIG. 13.
Figure 15:
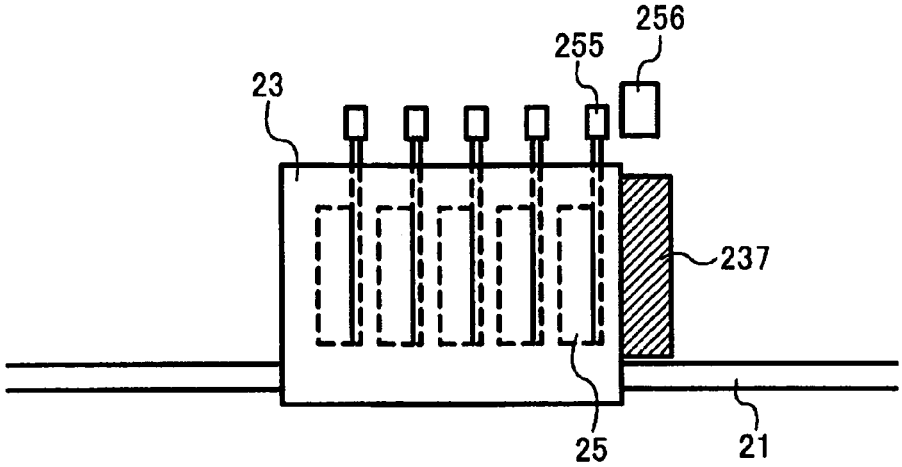
FIG. 15 illustrates a top view of a portion of the sub-tank of FIG. 13.

Another shielding mechanism according to another exemplary embodiment will be described referring to FIGS. 13 to 15. FIG. 13 illustrates a top view of the sub-tank 25. FIG. 14 illustrates a portion of the side view of the sub-tank 25 of FIG. 13. FIG. 15 illustrates a top view of the sub-tank 25.

The sub-tank 25 includes a tank body 251, a recording liquid storage 253, a spring 254, a full-tank detection lever 255 and a full-tank detection sensor 256. A flexible film 252 is attached to an opening of the tank body 251 and is sealed so as to form the recording liquid storage 253 to store recording liquid therein. The spring 254 is arranged to push the flexible film 252 towards an inside wall of the tank body 251. The full-tank detection lever 255 is arranged at an outer side of the flexible film 252 and is configured to change a top position of the full-tank detection lever 255 in accordance with a displacement of the flexible film 252.

To detect whether the sub-tank 25 is full with ink, the carriage 23 is moved to be located at a predetermined position. If the ink is supplied from the external ink cartridge 26 into, the sub-tank 25, the full-tank detection lever 255 has a displacement in accordance with the amount of the ink. If the displacement of the full-tank detection lever 255 reaches a predetermined position, a detection signal is output from the full-tank detection sensor 256 to indicate that the sub-tank 25 becomes full.

As shown in FIGS. 14 and 15, the shielding member 237 is arranged on the carriage 23 to prevent flying liquid droplet generated at the absorption of the unused ink ejected in the cap member 122*a* from attaching to the full-tank detection sensor 256 which is one of the predetermined members to be protected. In this exemplary embodiment, the shielding member 237 is arranged at a position where both full-tank detection sensor 256 and linear encoder scale 128 can be protected by the shielding member 237 from the flying liquid droplet.

Thus, the image forming apparatus 1 according to the exemplary embodiment includes the shielding member which prevents flying liquid droplet at the absorption of the recording liquid through the cap member from attaching to the predetermined members. It can be avoided that the predetermined members become dirty by the flying liquid droplet due to the broken bubble of the liquid droplet generated, especially when the recording liquid having high viscosity is used.

Figure 16:
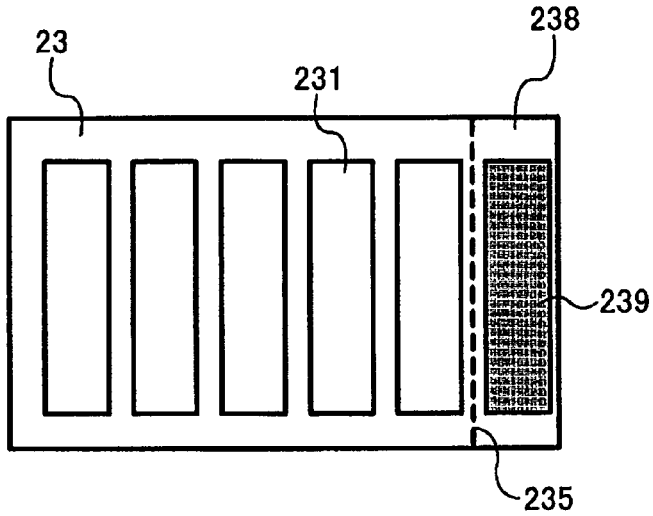
FIG. 16 illustrates a bottom view of a carriage according to another exemplary embodiment.
Figure 17:
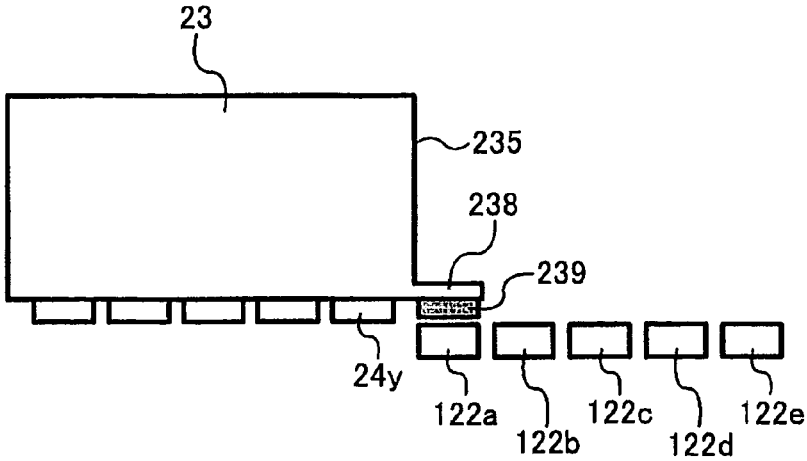
FIG. 17 illustrates a portion of a front view of the carriage of FIG. 16.

Another exemplary embodiment will be described referring to FIGS. 16 and 17. FIG. 16 illustrates a bottom view of a carriage 23. FIG. 17 illustrates a portion of a front view of the carriage 23 of FIG. 16. In this exemplary embodiment, a shielding component 238 is formed by extending a bottom plate of the carriage 23 over the sidewall 235 towards an outside of the carriage 23.

Moreover, the shielding component 238 is integrated into one piece with the carriage 23 and includes an absorption material 239 attached under the shielding component 238. With this configuration, the liquid droplet is absorbed by the absorption material 239 of the shielding component 238 so as to avoid the liquid droplet flying again. The absorption material 239 can be attached to the shielding members 237 in the other exemplary embodiments. The technology described using the exemplary embodiments are applicable to a variety of image forming apparatuses such as printers, facsimiles, copiers, multi-function peripherals, etc.

Numerous additional modifications and variations are possible in light of the above teachings. For example, elements and/or features of different illustrative embodiments or examples may be combined with each other and/or substituted for each other within the scope of this disclosure and appended claims. It is therefore to be understood that within the scope of the appended claims, the disclosure of this patent specification may be practiced otherwise than as specifically described herein.

This patent specification is based on Japanese patent application, No. 2005-154793 filed on May 27, 2005 in the Japan Patent Office, the entire contents of which are incorporated by reference herein.

What is claimed is:

1. An image forming apparatus, comprising:

a carriage;

a recording head mounted on the carriage, having a nozzle, and configured to form an image by ejecting recording liquid from the nozzle;

a self-maintenance mechanism configured to maintain the recording head in a predetermined condition and includes a cap member configured to cap the recording head, and an absorption mechanism configured to absorb recording liquid through the cap member from the recording head; and a shielding member configured to prevent a flying liquid droplet generated when the absorption mechanism absorbs the recording liquid from attaching to a predetermined member of the image forming apparatus, wherein the predetermined member includes a linear encoder scale configured to determine a position of the carriage in a scanning direction, and the shielding member is arranged at a position to cover both shortest and longest lines drawn between the cap member and the linear encoder scale.

2. The image forming apparatus of claim 1, wherein the recording liquid is absorbed from the recording head when the recording head is capped by the cap member, and is absorbed by the absorption mechanism after the recording head is separated from the cap member.

3. The image forming apparatus of claim 1, wherein the shielding member is arranged on a sidewall which is arranged in an orthogonal direction to a movement of the carriage on which the recording head is mounted.

4. The image forming apparatus of claim 3, wherein the shielding member is arranged on the sidewall in a direction substantially parallel to a nozzle surface of the recording head.

5. The image forming apparatus of claim 3, wherein the shielding member is arranged on the sidewall to be tilted with an angle to the nozzle surface of the recording head.

6. The image forming apparatus of claim 3, wherein the shielding member is arranged on the sidewall in a direction substantially vertical to the nozzle surface of the recording head.

7. The image forming apparatus of claim 3, wherein the shielding member is integrated into one piece with the carriage.

8. The image forming apparatus of claim 1, wherein the predetermined member includes a full-tank detector configured to detect an amount of recording liquid in a tank.

9. The image forming apparatus of claim 1, wherein the shielding member has a size greater than an opening area of the cap member.

10. The image forming apparatus of claim 1, wherein the shielding member is arranged on a sidewall of the carriage.

11. The image forming apparatus of claim 1, wherein the shielding member includes an absorption material.

12. An image forming apparatus, comprising:

carriage means;

recording head means mounted on the carriage, having a nozzle, for forming an image by ejecting recording liquid from the nozzle;

self-maintenance means for maintaining the recording head in a predetermined condition and includes cap means for capping the recording head means, and absorption means for absorbing recording liquid through the cap means from the recording head means; and shielding means for preventing a flying liquid droplet generated when the absorption means absorbs the recording liquid from attaching to a predetermined member of the image forming apparatus, wherein the predetermined member includes a linear encoder scale configured to determine a position of the carriage means in a scanning direction, and the shielding means is arranged at a position to cover both shortest and longest lines drawn between the cap means and the linear encoder scale.

13. A method for maintaining an area near a recording head of an image forming apparatus in a clean condition; said method comprising (a) ejecting recording liquid through a nozzle of the image forming apparatus;

(b) absorbing recording liquid through a cap member of the image forming apparatus;

(c) utilizing a shielding member to prevent a flying liquid droplet, generated when the recording liquid is absorbed in (b), from contaminating one or more other predetermined members, inc1uding a linear encoder scale configured to determine a position of the carriage in a scanning direction, of the image forming apparatus, wherein the shielding member is arranged at a position to cover both shortest and longest lines drawn between the cap member and the linear encoder scale.

* * * * *